US007942095B2

(12) United States Patent
Cady et al.

(10) Patent No.: US 7,942,095 B2
(45) Date of Patent: May 17, 2011

(54) BAG DISPENSER FOR PROVIDING BAGS AT A WORKSTATION AND METHOD

(75) Inventors: Derril R. Cady, Manawa, WI (US); Thomas L. Glatfelter, Jr., York, PA (US)

(73) Assignee: Greydon, Inc., York, PA (US)

( * ) Notice: Subject to any disclaimer, the term of this patent is extended or adjusted under 35 U.S.C. 154(b) by 1589 days.

(21) Appl. No.: 11/270,434

(22) Filed: Nov. 9, 2005

(65) Prior Publication Data

US 2007/0069449 A1 Mar. 29, 2007

Related U.S. Application Data

(60) Provisional application No. 60/720,836, filed on Sep. 27, 2005.

(51) Int. Cl.
*B41F 17/00* (2006.01)
*B65B 61/26* (2006.01)
*B65B 61/02* (2006.01)

(52) U.S. Cl. ..... 101/35; 101/43; 101/44; 53/131.2; 53/411

(58) Field of Classification Search ..... 101/35, 101/41, 43–44; 53/131.2, 131.5, 411
See application file for complete search history.

(56) References Cited

U.S. PATENT DOCUMENTS

| | | | | |
|---|---|---|---|---|
| 3,587,843 | A | 6/1971 | Wing | 206/57 |
| 3,698,547 | A | 10/1972 | Roberts et al. | 206/57 |
| 3,774,367 | A | 11/1973 | Lerner | 53/67 |
| 3,908,343 | A * | 9/1975 | Farrelly | 53/385.1 |
| 4,113,139 | A | 9/1978 | Berry et al. | 221/1 |
| 4,202,153 | A | 5/1980 | Lerner et al. | 53/459 |
| 4,393,640 | A | 7/1983 | Cole et al. | 53/69 |
| 5,826,405 | A | 10/1998 | Killinger et al. | 53/459 |
| 6,834,472 | B2 | 12/2004 | Kujubu et al. | 53/64 |
| 6,837,023 | B1 | 1/2005 | Glatfelter, Jr. | 53/64 |
| 7,133,639 | B2 * | 11/2006 | Yuyama et al. | 399/397 |
| 2003/0106285 | A1 * | 6/2003 | Cronauer et al. | 53/411 |
| 2004/0266597 | A1 | 12/2004 | Melville | 493/149 |
| 2007/0182087 | A1 * | 8/2007 | Yasuoka et al. | 271/151 |

FOREIGN PATENT DOCUMENTS

GB 2064477 6/1981

* cited by examiner

*Primary Examiner* — Leslie J Evanisko
*Assistant Examiner* — Marissa L Ferguson-Samreth
(74) *Attorney, Agent, or Firm* — Hooker & Habib, P.C.

(57) ABSTRACT

A bag dispenser feeds a bag assembly for supplying bags to a work station for manual removal from the bag assembly as needed. Each bag is printed with information such as packing date or packing location prior to reaching the work station.

13 Claims, 5 Drawing Sheets

BAG DISPENSER FOR PROVIDING BAGS AT A WORKSTATION AND METHOD

This application claims the benefit of U.S. Provisional Application No. 60/720,836 filed Sep. 27, 2005.

FIELD OF THE INVENTION

The invention relates to bag dispensers that provide or supply bags for bagging product at a workstation, and in particular bag dispensers that provide bags printed with product data, and related methods.

BACKGROUND OF THE INVENTION

Food products, such as meat, cheese and the like, are conventionally packaged in plastic bags at workstations. The bags are supplied to a workstation in a bag assembly in which lead ends of the bags adhere to tape strips and trailing ends overly each other. The tape strips are fed to the workstation and the bags are removed from the tape strips for use.

Packaged food products must carry date and product source information. This information is conventionally printed on the bags in the bag assembly before reaching the workstation. A printer prints information on exposed sides of the bags in the bag assembly. The bags overlap each other so that the surface on a bag exposed for printing extends longitudinally along the bag assembly from the end of an overlying, downstream bag to the end of the bag being printed. The spacing of the bags along the strips is not necessarily uniform, thus making reliable printing difficult.

Glatfelter, Jr. U.S. Pat. No. 6,837,023, application Ser. No. 10/880,208, filed Jun. 29, 2004, issued Jan. 4, 2005 and assigned to the common assignee of this application, and which is incorporated herein by reference, discloses an improved bagger which reliably prints product information on bags independently of the spacing of the bags along the bag assembly. The bagger individually senses the location of a bag in the assembly, stops the feed of the assembly past a bag printer, and prints all required information on the bag.

The bagger disclosed in the Glatfelter, Jr. patent feeds the bag assembly to a work surface at the workstation. A bag is supported on the work surface and is opened by an air blast for inserting product into the bag. The bagger is intended for high-production workstations where product is automatically bagged and sealed.

There still remains a need, however, for a bag dispenser that supplies printed bags that can be manually removed from the bag assembly as needed. For example, large cuts of meat often cannot be packaged with automatic baggers, nor can work surfaces be provided at all existing workstations. The bag dispenser should reliably print product data on bags supplied to a work station to be manually removed from the bag assembly as needed.

SUMMARY OF THE INVENTION

The invention is an improved bag dispenser that reliably prints product data on bags supplied to a work station for manual removal from the bag assembly as needed.

A bag dispenser in accordance with the present invention includes a support surface and a printer associated with the support surface. A drive moves a bag assembly downstream past the support surface, with opposed holddown surfaces that retain the trailing portion of a bag moving past the support surface. The trailing portion of each bag is moved past the holddown surfaces and away from the support surface to expose a print area on a trailing bag. A control circuit operates the drive and the printer, and includes a first sensor configured to detect that the trailing portion of the bag is away from the support surface. The sensor stops the drive to stop movement of the bag assembly across the support surface and activates the printer to print product information on the print area of the trailing bag on the support surface.

The drive moves the bag assembly downstream past the support surface to a bag-removal station for removal of a printed bag from the bag assembly. The bag assembly is positioned at the bag-removal station such that the bag to be removed is spaced away from an adjacent bag to facilitate removal of the bag.

In a preferred embodiment of the present invention the bag assembly moves downhill past the support surface so that gravity urges the trailing end of a bag away from the support surface and towards the sensor. An air nozzle discharges an air blast assisting the weight of the bag urging the bag away from the support surface and past the sensor.

In yet another preferred embodiment of the present invention the leading end of one bag reaches the bag-removal station when the trailing end of another bag, or the trailing end of the same bag if the bags are sufficiently long, clears the holddown surfaces and moves away from the support surface. The control circuit stops the drive until the bag is removed from the bag-removal station. A second sensor detects that the bag has been removed and re-starts the drive. The position of the second sensor along the bag assembly is adjustable to compensate for differences in bag length between different bag assemblies or to selectively position the bag-removal station in the work station.

The bag dispenser of the present invention reliably provides a supply of printed bags to a workstation for manual removal from the bag assembly without the need for a work surface. The bag dispenser can be used with bag assemblies having bags of different lengths, and yet is inexpensive enough and compact enough that it is practical to equip a workstation with a number of the bagging devices. Each device can be dedicated to a different type or size of bag.

Other objects and features of the invention will become apparent as the description proceeds, especially when taken in conjunction with the accompanying drawings illustrating the invention, of which there are 5 sheets of drawings of one embodiment.

DESCRIPTION OF THE PREFERRED EMBODIMENT

Figure 1:
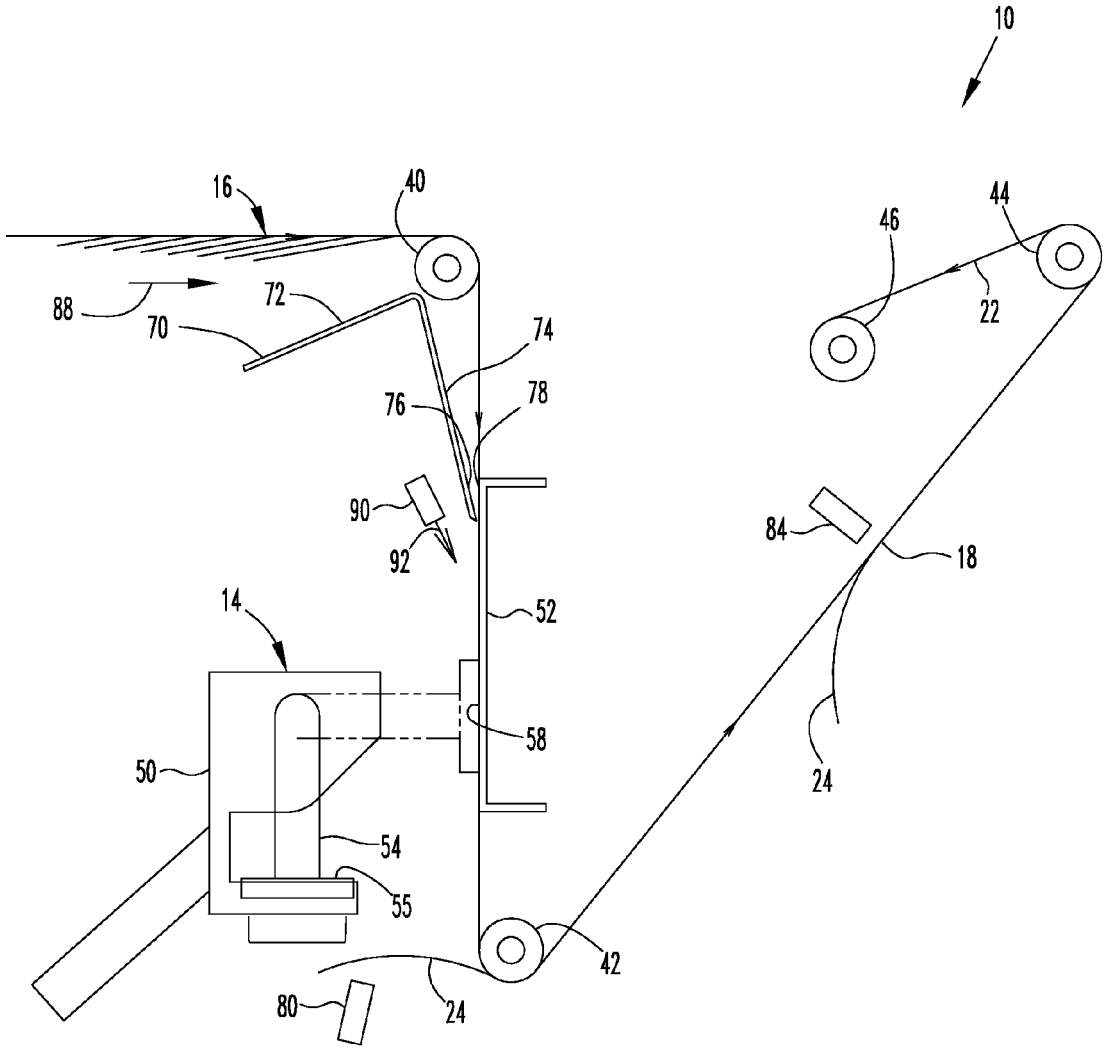
FIG. 1 is a schematic side view of a bag dispenser in accordance with the present invention.
Figure 2:
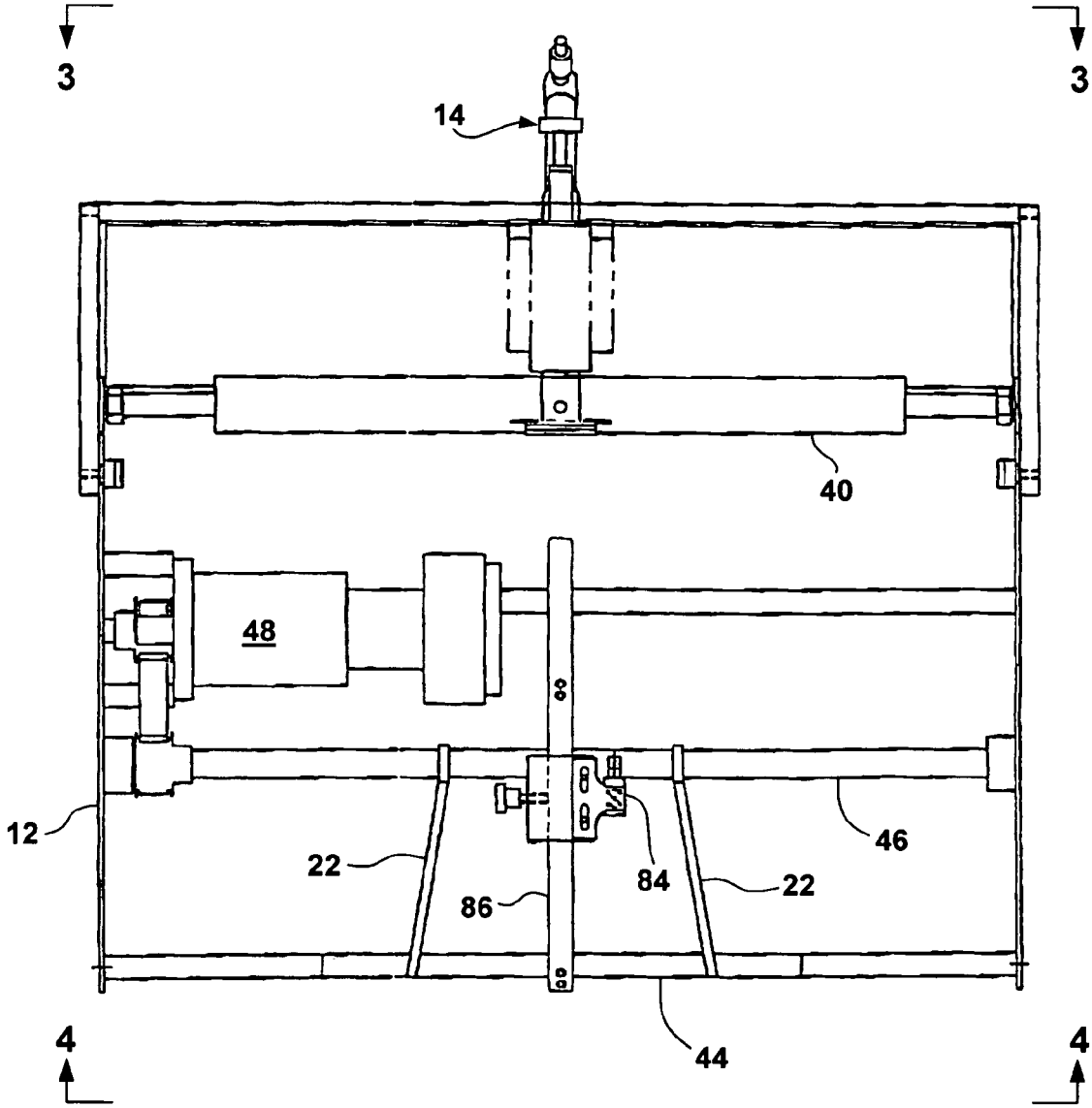
FIG. 2 is a top view of the bag dispenser.
Figure 3:
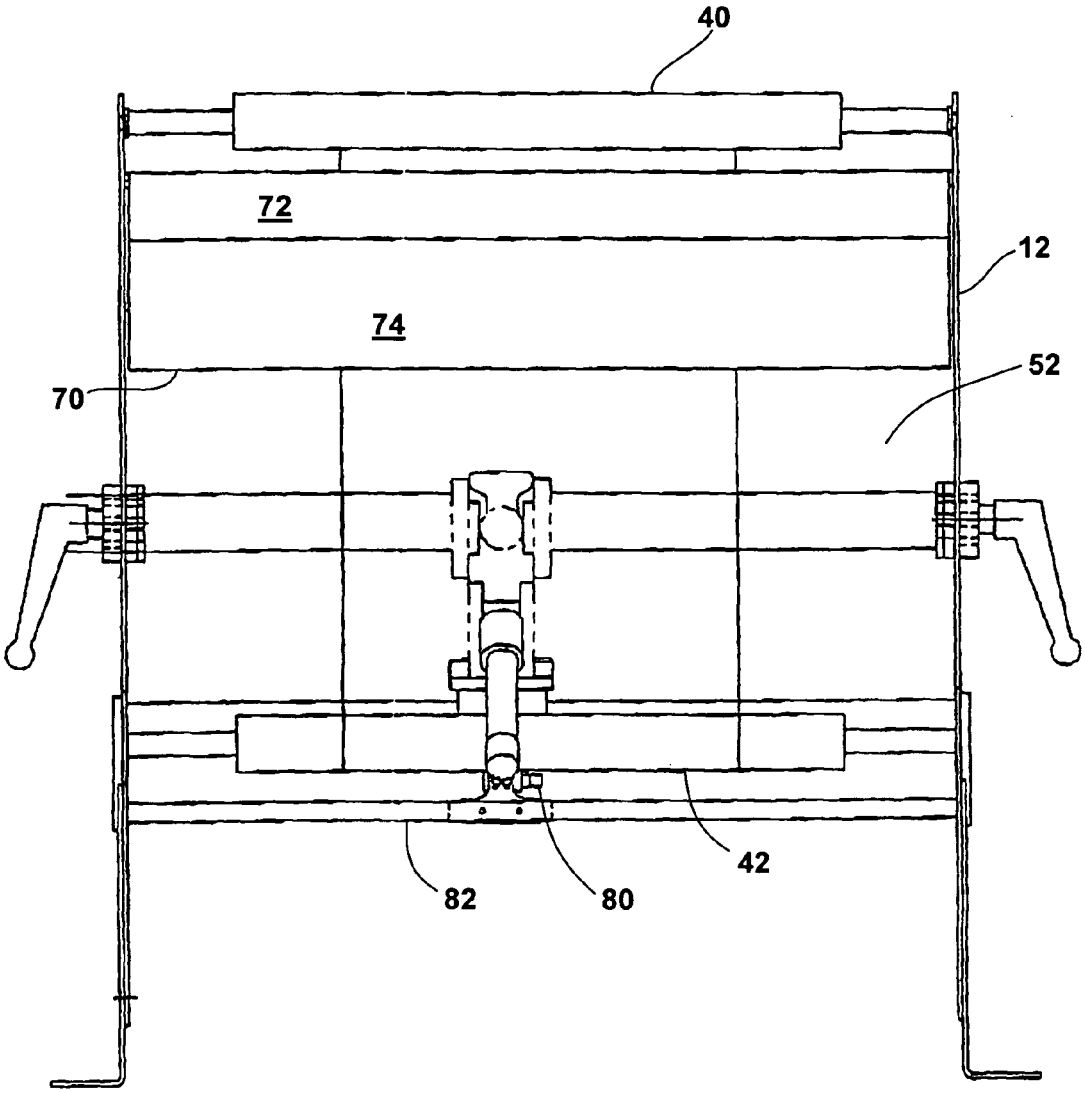
FIG. 3 is a first end view of the bag dispenser taken along line 3-3 of FIG. 2.
Figure 4:
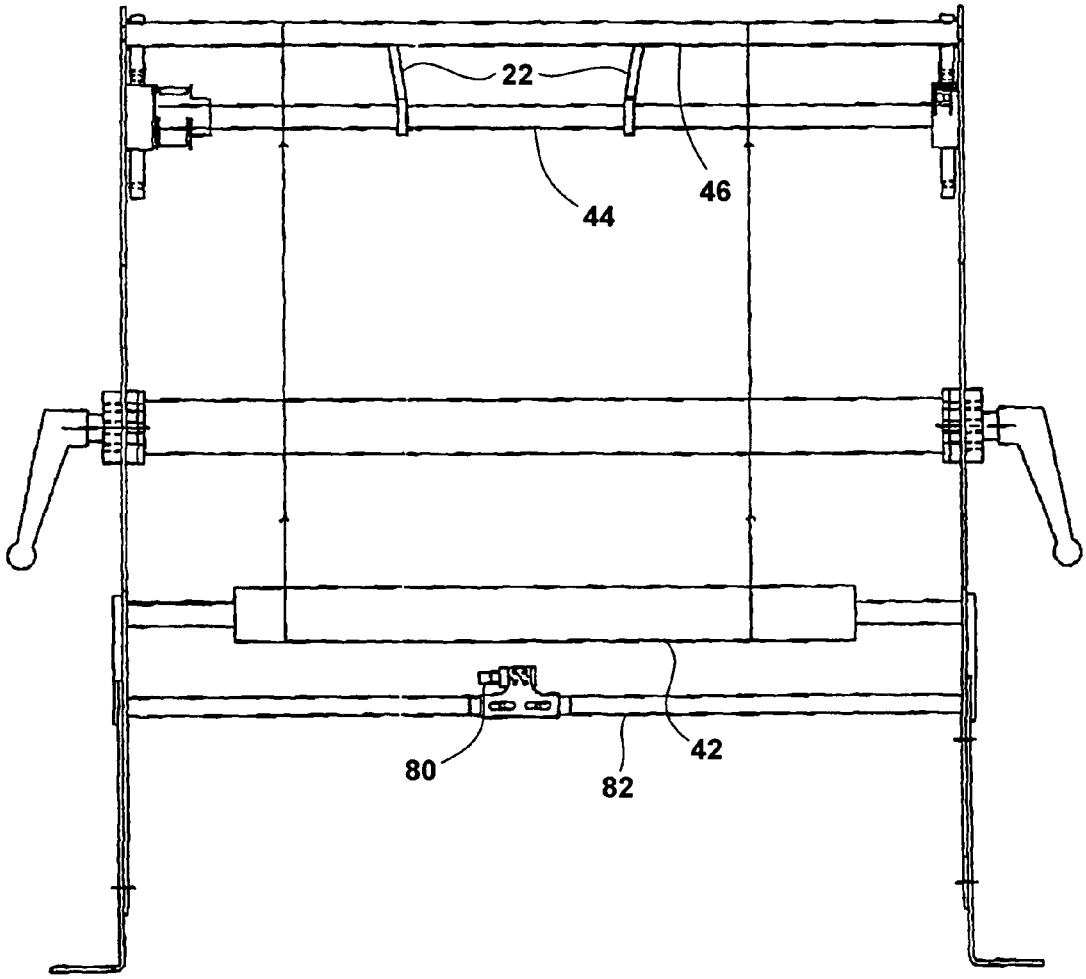
FIG. 4 is an opposite end view of the bag dispenser taken along line 4-4 of FIG. 2.

FIG. 1-4 illustrate a bag dispenser 10 in accordance with the present invention (for clarity, some figures omit some components). The bag dispenser is used to provide bags for a user at a workstation (not shown). The bag dispenser includes a frame 12 and a bag printer assembly 14 mounted on the rear of the frame 12. An indefinite-length shingled bag assembly 16 is fed from a box (not shown), through printer assembly 14 and to a take-out station or bag-removal station 18. The printer assembly prints desired information, typically date and source information, on each bag in the bag assembly prior to the bag reaching the bag-removal station 18. In this way bags with pre-printed product information are made individually available at the workstation.

Feed of the shingled bag assembly 16 stops when a printed bag reaches the bag-removal station. After the bag is removed, the next bag of bag assembly 16 is moved to the bag-removal station 18 to provide a continually-refreshed supply of individually-printed bags to the workstation. Detailed operation of the machine 10 will be described later below.

Figure 5:
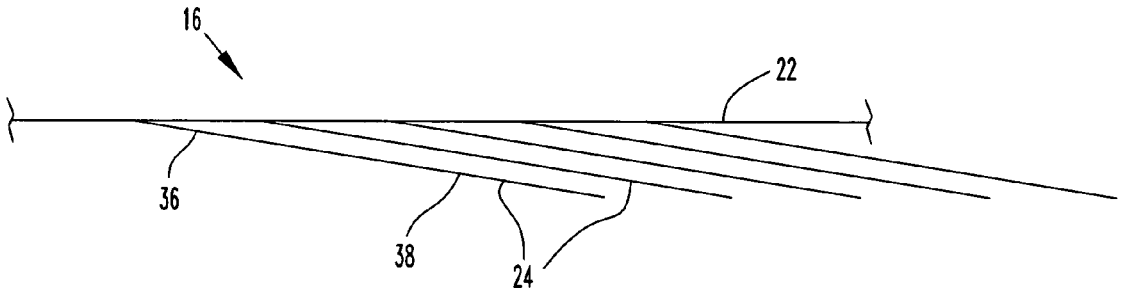
FIG. 5 is a side view of overlapped or shingled bags in a bag assembly.

The shingled bag assembly 16 is similar to the bag assembly described in the Glatfelter, Jr. patent. The bag assembly includes two spaced, parallel indefinite length elongate members formed by adhesive strips 22. See FIG. 5. A plurality of generally rectangular shingled plastic bags 24 adhere to strips 22. Each bag 24 has an open lead portion 36 that adheres to the strips and a closed trailing portion 38 that shingle or overly each other and are not joined to strips 22. The trailing portions 38 may have a length along the assembly considerably greater than the length of adhered lead portions 36.

Support plate 52 defines a vertical support surface 58 facing the printer 50 such that print head 55 presses a bag against the surface when printing. The rollers 40, 42 are arranged so that the bag assembly 16 travels vertically downward past the support surface 58 with the bag assembly 16 flush against the surface.

An "L" shaped beam 70 is attached to the frame parallel with the rollers between the upper roller 40 and the support plate 52. Beam 70 includes an upper leg 72 extending away from the roller 40 and a lower leg 74 extending past the upper end of the support plate 52. The beam 70 is oriented along its longitudinal axis such that each leg slopes towards the bag assembly as the bag assembly moves past the leg. The lower leg 74 and the upper end of support plate 52 have opposed surfaces 76, 78 that define holddown surfaces facing opposite sides of the bag assembly as the bag assembly moves past leg 74 and approaches the print support surface 58.

A control circuit controls operation of the drive motor 48 and stamp printer 50. The circuit includes a first, trailing end sensor 80 that determines when a bag is positioned for printing. Sensor 80 can be a motion sensor or proximity sensor. Sensor 80 is mounted to the frame on a support member 82 that positions the sensor below the support plate 52. A second sensor 84 detects the presence or absence of a bag at the bag removal station 18. Sensor 84 is mounted on a bracket 86 that positions the sensor 84 between the rollers 42, 44. Sensor 84 is adjustably mounted on the bracket for manual positioning of the sensor 84 between the rollers.

Operation of the bag dispenser 10 will now be described.

Shingled bag assembly 16 is provided in a box (not shown) and is pulled from the box with the tape strips 22 on the upper side of the assembly and the bags 24 on the lower side of the assembly. The bag assembly 16 is place over the top roller 40 and fed between the holddown surfaces 76, 78, past the support plate 52 with the tape strips 22 adjacent the support plate, and around the lower roller 42 and the forward roller 44. The lead end of the bag assembly is stripped of bags and the bare tape strips 22 are wound around the take-up reel 46.

The control circuit activates the drive motor 48 to rotate the take-up reel 46 and feed the bag assembly 16 downstream from the box and through the frame. The bag assembly is fed downstream in the direction of arrow 88 and approaches the top roller 40 with the bag trailing ends 38 hanging below the adhesive strips 22. The upper channel leg 72 supports the trailing ends of the bags as the bags approach the top roller. The slope of the leg 72 with respect to the travel path of the bag assembly assists the leg 72 in forcing the trailing ends of the bags to return to an overlapping position as the bag assembly moves around the top roller 40.

The bag assembly leaves top roller 40 and moves vertically downwards towards the lower roller 42 and past the support surface 58. The trailing ends of the bags extend upwardly along the bag assembly as they leave the top roller 40 and are maintained in overlapping condition by leg 74. As the bag assembly moves along the leg 74, the holddown surfaces 76, 78 cooperate to maintain the trailing ends of the bags in their overlapping condition until clearing leg 74 a predetermined distance from the support surface 58. A portion of the underlying bag is on the support surface 58 for printing as a bag clears leg 74.

When the trailing end of a bag clears the holddown surfaces, that is, when a bag moves past leg 74, gravity urges the trailing end of the bag downwardly and away from the support surface 58. An air nozzle 90 mounted on the frame 12 directs an air blast represented by arrow 92 against the end of the bag. The air blast assists gravity in urging the bag away from the support surface 58. If the bag has sufficient weight for gravity to reliably move the trailing end of the bag away from the support surface, the nozzle can be eliminated or the control circuit can be set to not actuate the nozzle. In yet other embodiments vacuum or other forms of generating differential air-pressure on opposite sides of the bag can be used if desired.

The trailing end of the bag moves past the first sensor 80 sufficiently close to actuate the sensor. This is best seen in FIG. 1; the length of the bag is actually longer than shown in the drawing. Sensor actuation stops the drive motor 48 for a predetermined time and actuates the stamp printer 50 to have the print head 55 print product data on the underlying bag against the support surface 58. Sensor 80 stops the drive motor a sufficient time to enable printing, typically about one-quarter to one-half second.

Drive motor 48 restarts to drive a printed bag to the bag removal station 18. Sensor 84 is positioned to be actuated when a bag reaches the bag station 18. Actuation of sensor 84 stops the drive motor 48 and shuts off nozzle 90. The position of the sensor 84 determines the downstream location of the bag-removal station 18 from the holddown surfaces 76, 78.

The printed bag remains stationary at the bag-removal station 18 for manual removal of the bag from the bag assembly 16. At the bag-removal station the tape strips 22 are on the upper side of the bag assembly and a bag is supported solely by the attachment of the lead portion of the bag to the tape strips 22. The bag hangs down away from the tape strips 22 and the bag assembly has a sufficient uphill slope to enable the bag to hang freely and spaced away from the next downstream bag for easy removal.

The bagging device 10 is capable of supplying relatively large, long bags. The preferable position of the bag-removal station 18 for a long bag (as is typically used for bagging large cuts of meat) is such that when the trailing end of a bag clears the holddown surfaces 76, 78, the leading end of the bag simultaneously arrives at the bag-removal station 18. In other words, the bag-removal station 18 is preferably spaced the nominal length of a bag 24 downstream from the leg 74 when device 10 is used to dispense long bags.

When sensor 84 is spaced a bag-length downstream from leg 74, sensor 84 may detect the arrival of a bag at the bag-removal station 18 essentially simultaneously with the same bag actuating upstream sensor 80. If so, drive motor 48 will not restart after printing because sensor 84 was actuated when the motor was stopped. As the trailing end of the next downstream bag is still retained by the holddown surfaces 76, 78 against the bag assembly, a bag at the bag-removal station 18 is spaced away from the next downstream bag and is the only bag hanging freely from the tape strip 22 downstream of the support plate 52. This enables a worker in a high-production environment to more easily remove single bags from the device 10.

Removal of a bag from the bag-removal station 18 is detected as a lack of a bag at the station by the second sensor 84. The control circuit responds by restarting the drive motor to move the next bag past the holddown surfaces 76, 78 and repeat the printing process and driving a printed bag to the bag-removal station 18.

The bagging device 10 is intended for use with bag assemblies having different bag lengths. The position of the second sensor 84 between rollers 42, 44 is adjusted as necessary when changing bag assemblies to detect the leading portion of a bag as it clears leg 74. Sensor 84 is placed some first distance from leg 74 when supplying bags having a first bag length and is placed some second distance from leg 74 when supplying bags having a second, different bag length.

Device 10 is shown in FIG. 1 with the bag-removal station 18 downstream from leg 74 farther than the bag length, requiring the bag assembly 16 to be fed downstream the additional distance after a bag clears the holddown surfaces 76, 78. The control circuit restarts drive motor 48 after printing and stops the motor when the second sensor 84 detects the arrival of a bag at the bag-removal station 18.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

What we claim as our invention is:

1. A method of supplying individual bags for bagging product, each bag to be printed with product information, the bags provided as an indefinite length assembly of shingled bags where each bag has a lead portion adhered to the indefinite length assembly, a shingled trailing portion overlying an adjacent upstream bag, and is upstream from downstream bags, the method comprising the steps of:

(a) moving the indefinite length assembly along a path, the path extending downhill across a support member and from the support member to a bag-removal station;

(b) retaining the trailing portion of each bag against a holddown surface to hold the trailing portion of the bag against an underlying bag in the assembly while the bag is moving across the support member;

(c) releasing the retained trailing portion of the bag from the holddown surface prior to the retained trailing portion clearing the support member, gravity urging the released trailing portion of the bag away from the support member to uncover the underlying bag;

(d) printing product information on the underlying bag against the support member;

(e) positioning the lead portion of the bag above the trailing portion of the bag after the bag moves past the support surface so that gravity urges the trailing portion of the bag away from the lead portion of the bag; and (f) stopping the indefinite length assembly when the bag reaches the bag-removal station wherein the bag can be removed from the indefinite length assembly for use.

2. The method of claim 1 wherein the lead portion of a bag is at the bag-removal station when the trailing portion of the same bag is released from the hold-down surface.

3. The method of claim 1 wherein step (c) comprises the step of:

(g) applying differential fluid pressure against the released trailing portion of the bag to assist gravity in urging the released trailing portion away from the support member.

4. The method of claim 1 comprising the step of:

(g) moving the indefinite length assembly along the path uphill from the support member to the bag-removal station.

5. The method of claim 1 comprising the step of:

(g) re-starting movement of the indefinite length assembly when a bag at the bag-removal station is removed from the assembly.

6. The method of claim 1 wherein the indefinite length assembly has bags of a bag length and comprising the step of:

(g) locating the bag-removal station a predetermined distance from the holddown surface as a function of the bag length.

7. The method of claim 6 comprising the step of:

(h) locating the bag-removal station a first distance for supplying a first indefinite length assembly having bags of a first bag length; and (i) locating the bag-removal station a different second distance for supplying a second indefinite length assembly having bags of a different second bag length.

8. A method of individually providing bags with data printed on each bag, the bags provided as an indefinite-length bag assembly comprising an elongate member, bags detachably attached to the elongate member, each bag having a bag weight and comprising a lead portion attached to one side of the elongate member and a trailing portion overlapping a portion of an adjacent upstream bag, the method comprising the steps of:

(a) moving the indefinite-length bag assembly in a downstream direction longitudinally across a support member until the trailing portion of a bag reaches a known position wherein the overlapped portion of the adjacent upstream bag is over the support member;

(b) moving the trailing portion of the bag away from the support member to uncover the overlapped portion of the adjacent upstream bag and printing data on the uncovered portion of the upstream bag against the support member;

(c) moving the indefinite-length bag assembly away from the support member until the bag moves to a take-out station downstream from the support member;

(d) orienting the indefinite-length bag assembly such that the elongate member is above the bag when the bag reaches the take-out station so that the weight of the bag urges the bag away from the elongate member at the take-out station; and (e) stopping the indefinite-length bag assembly when a printed bag reaches the take-out station whereby a user can remove the printed bag from the elongate member for use.

9. The method of claim 8 comprising the step of:

(f) re-starting movement of the bag assembly when the printed bag at the take-out station is removed from the assembly.

10. The method of claim 8 comprising the step of:

(f) spacing the bag at the take-out station away from the adjacent upstream bag.

11. The method of claim 10 wherein step (f) comprises the step of:

(g) holding the trailing portion of the adjacent upstream bag against a next adjacent upstream bag.

12. The method of claim 8 comprising the steps of:

(f) establishing the take-out station a first known distance from the support plate and providing bags from a first bag assembly at the first distance, each bag having a first length;

(g) establishing the take-out station a different second known distance from the support plate and providing bags from a second bag assembly for removal at the second distance, each bag having a second length different from the first length.

13. The method of claim 8 comprising the step of:

(f) establishing the take-out station a predetermined distance from the support plate such that the trailing portion of the upstream bag adjacent to a bag at the take-out station has not yet moved away from the support surface.

* * * * *